US005295686A

United States Patent [19]

Lundberg

[11] Patent Number: 5,295,686

[45] Date of Patent: Mar. 22, 1994

[54] GOLF CLUB SET

[75] Inventor: Harry C. Lundberg, Ramsey, N.J.

[73] Assignee: S2 Golf Inc., Fairfield, N.J.

[21] Appl. No.: 8,393

[22] Filed: Jan. 25, 1993

Related U.S. Application Data

[63] Continuation of Ser. No. 747,203, Aug. 16, 1991, abandoned.

[51] Int. Cl.[5] ..... A63B 53/04

[52] U.S. Cl. ..... 273/77 A; 273/167 F; 273/169; 273/167 A

[58] Field of Search ..... 273/167 R-177 A, 273/77 R, 193 R, 194 R, 162 R, 164.1

[56] References Cited

U.S. PATENT DOCUMENTS

| | | | |
|---|---|---|---|
| D. 92,266 | 5/1934 | Nicoll et al. | 273/167 F X |
| 1,139,985 | 5/1915 | Legh | 273/167 F X |
| 1,525,148 | 2/1925 | Pickop | 273/167 F |
| 1,671,956 | 5/1928 | Sime | 273/167 F X |
| 2,007,377 | 7/1935 | Link | 273/167 F |
| 3,059,926 | 10/1962 | Johnstone | 273/77 A |
| 3,655,188 | 4/1972 | Solheim | 273/77 A |
| 3,845,955 | 11/1974 | Solheim | 273/77 A |
| 3,955,820 | 5/1976 | Cochran et al. | 273/169 X |
| 4,058,312 | 11/1977 | Stuff et al. | 273/77 A |
| 4,512,577 | 4/1985 | Solheim | 273/77 A |
| 4,645,207 | 2/1987 | Teramoto et al. | 273/77 A |
| 4,715,601 | 12/1987 | Lamana | 273/77 A |
| 4,848,747 | 7/1989 | Fujimura et al. | 273/77 A |
| 4,854,580 | 8/1989 | Kobayashi | 273/77 A |
| 4,913,435 | 4/1990 | Kobayashi | 273/77 A |
| 4,921,252 | 5/1990 | Antonious | 273/169 X |
| 5,011,151 | 4/1991 | Antonious | 273/164.1 |

FOREIGN PATENT DOCUMENTS

| | | | |
|---|---|---|---|
| 2842245 | 4/1979 | Fed. Rep. of Germany | 273/77 A |
| 371974 | 5/1932 | United Kingdom | 273/167 F |
| 2170719 | 8/1986 | United Kingdom | 273/77 A |
| 2200558 | 8/1988 | United Kingdom | 273/77 A |

OTHER PUBLICATIONS

"Golf Digest" magazine, Dec. 1974 issue, p. 31, ad for *Soft Touch Irons.*

"Golf Digest" magazine, May 1972 issue, p. 21, ad for *Spalding Executive Irons.*

"Golf World" magazine, Dec. 1977 issue, p. 63, ad for *Titleist Lite 100's.*

"Golf World" magazine, Nov. 1977 issue, p. 31, ad for *Accubar 78.*

*Primary Examiner*—Vincent Millin

*Assistant Examiner*—Sebastiano Passaniti

*Attorney, Agent, or Firm*—Webb, Burden, Ziesenheim & Webb

[57] ABSTRACT

An improved set of golf clubs has iron club heads in a correlated set such that the weight of longer shafted, less lofted clubs is concentrated more towards the heel of the head, while the weight of the shorter shafted, more lofted clubs is concentrated more towards the toe of the head. When viewed face on, with the sole of the club on a level surface, it will be noted that the vertical plane of the center of gravity of each individual head shall be shifted towards the toe or the heel, as the case may be, with such weight concentrations. The result is a set of correlated golf club heads which: (a) have less inertial drag in the longer, less lofted clubs, (b) have more inertial drag in the shorter, more lofted clubs, and (c) can utilize the gear effect phenomenon inherent in golf clubs more effectively.

3 Claims, 2 Drawing Sheets

GOLF CLUB SET

This is a continuation-in-part of copending application(s) Ser. No. 07/747,203 filed on Aug. 16, 1991 now abandoned.

BACKGROUND OF THE INVENTION

1. Field of the Invention

The present invention pertains to iron clubs for use on fairways, and on tees from time to time, generally to approach the greens on a golf course. The object is to retard the tendency of the right-handed golfer to hit the ball with left to right spin in the case of longer irons, i.e., Nos. 1, 2, 3, 4, or pull the ball to the left of target when using the shorter, more lofted irons, i.e., Nos. 7, 8, 9 and 10 (vice versa if the player is left-handed).

2. Description of the Prior Art

Today, designs of clubs are essentially regulated by the United States Golf Association, among others, who have design constraints so that the element of skill is not removed from the playing of the game. Notwithstanding such constraints, golfers in general seek game improvement aids. Many have been made over the last decade consistent with the rules of the governing bodies.

Over the course of time, it has been noted and well recorded that golfers have difficulties with long irons, particularly Nos. 1, 2 and 3. Many golfers have been known to purchase such clubs but never use them in play due to difficulty of use. One particular difficulty is commonly called "slicing". The golfer imparts a spin on the ball such that it travels through the air with a pronounced curve away from his target line, to the side of the course he was facing while at address, prior to swinging at the ball. While expert golfers can deliberately make such shots to suit particular game conditions, such "slicing" is generally considered poor, yielding loss of distance and control. While no design can purport to completely eliminate "slicing" and yet conform to the constraints of the governing bodies, repeated experiments have shown the tendency can be retarded.

A second difficulty occurs with shorter clubs, i.e., Nos. 7, 8, 9 and 10, commonly called "pulling". The ball tends to travel off the target line, to the side of the course opposite to where the golfer was facing at address. Often this is a result of the same swing plane used on the longer irons to produce "slicing", but due to the fact that the clubs are shorter, with consequent less drag during the swing, the resultant shot often results in an undesirable "pull".

To understand the force the golfer must exert to attain a desired club head speed, one should view the swing as a rotating body. See U.S. Pat. No. 4,058,312 to Stuff, et al., where FIG. 1 illustrates the circular pattern of the swing. Since the head of the club is the predominant weight, the swing produces the well-known fly wheel effect. The net torque the golfer must supply to produce the desired swing speed is equal to moment of inertia times angular acceleration ($T=ML^2\times A$). Since moment of inertia must be calculated by taking all the several weights contained in a club and multiplying by the length squared of each weight measured back to the end of the grip, it is apparent that any weight location in the head has a large bearing on the amount of force the golfer must supply, since this is the maximum distance zone from the grip or axis of rotation.

If one were to view the plane of the golf swing from a vantage point above the golfer, looking down on the player, a circular motion will also be observed. Clearly, the head of the golf club, at furthest length from the axis of rotation, is the part of the club travelling at highest velocity. In the well-known Impulse-Momentum laws governing bodies in collision, it can be seen that the momentum (MV) will be increased should the weight of the head be placed more towards its toe. (See U.S. Pat. No. 3,059,926 to Johnstone).

In ideal circumstances, whenever momentum can be increased, the distance the golf ball will travel must also be increased. Were this the sole factor in producing acceptable to good golf shots, all clubs might well be toe weighted to maximize momentum. It has been observed that the vast preponderance of golfers swing their clubs at either their personal comfort zone (near maximum power) up to maximum power. A very slight increase in effective length of mass to axis of rotation will frequently cause acceleration to be reduced (acceleration equals force divided by moment of inertia) thus reducing club head velocity at impact. Observations show that such as action tends to twist the club head open and accounts for the persistence of long iron slicing.

Since the length of the shorter clubs, such as a 9-iron, is ordinarily 35½ inches, and is 3½ inches less than a 2-iron of such a set, the length difference being squared in torque calculations, the golfer has an easier time accelerating a short club in spite of the heavier head found in such a club. This accounts for the persistence of short club pulling.

Table I, below, illustrates how typical iron shaft lengths, for both men and women, decrease as the loft of each club increases.

TABLE I

| TYPICAL IRON SHAFT LENGTHS | | |
|---|---|---|
| IRON NUMBER | MEN | LADIES |
| 1 | 39½ INCHES | 38½ INCHES |
| 2 | 39 INCHES | 38 INCHES |
| 3 | 38½ INCHES | 37½ INCHES |
| 4 | 38 INCHES | 37 INCHES |
| 5 | 37½ INCHES | 36½ INCHES |
| 6 | 37 INCHES | 36 INCHES |
| 7 | 36½ INCHES | 35½ INCHES |
| 8 | 36 INCHES | 35 INCHES |
| 9 | 35½ INCHES | 34½ INCHES |
| 10 | 35½ INCHES | 34½ INCHES |
| 11 | 35 INCHES | 34 INCHES |

Prior art has generally designed iron golf club heads in one of two ways:

To understand the force the golfer must exert to attain a desired club head speed, one should view the swing as a rotation body. See U.S. Pat. No. 4,058,312 to Stuff, et al., where FIG. 1 illustrates the circular pattern of the swing. Since the head of the club is the predominant weight, the swing produces the well-known fly wheel effect. The net torque the golfer must supply to produce the desired swing speed is equal to moment of inertia times angular acceleration ($T=ML^2\times A$). Since moment of inertia must be calculated by taking all the several weights contained in a club and multiplying by the length squared of each weight measured back to the end of the grip, it is apparent that any weight location in the head has a large bearing on the amount of force the golfer must supply, since this is the maximum distance zone from the grip or axis of rotation.

If one were to view the plane of the golf swing from a vantage point above the golfer, looking down on the player, a circular motion will also be observed. Clearly, the head of the golf club, at furthest length from the axis of rotation, is the part of the club travelling at highest velocity. In the well-known Impulse-Momentum laws governing bodies in collision, it can be seen that the momentum (MV) will be increased should the weight of the head be placed more towards its toe. (See U.S. Pat. No. 3,059,926 to Johnstone).

In ideal circumstances, whenever momentum can be increased, the distance the golf ball will travel must also be increased. Were this the sole factor in producing acceptable to good golf shots, all clubs might well be toe weighted to maximize momentum. It has been observed that the vast preponderance of golfers swing their clubs at either their personal comfort zone (near maximum power) up to maximum power. A very slight increase in effective length of mass to axis of rotation will frequently cause acceleration to be reduced (acceleration equals force divided by moment of inertia) thus reducing club head velocity at impact. Observations show that such as action tends to twist the club head open and accounts for the persistence of long iron slicing.

Since the length of the shorter clubs, such as a nine iron, is ordinarily 35½ inches, and is 3½ inches less than a two iron of such a set, the length difference being squared in torque calculations, the golfer has an easier time accelerating a short club in spite of the heavier head found in such a club. This accounts for the persistence of short club pulling.

A. The center of mass of the head was in the center of the face of the head, viewed in the vertical plane (FIG. 1); or B. The center of mass was in the toe area of the long clubs, progressing gradually towards the heel area of the short clubs, commonly called "flow weighting" (FIGS. 2 and 3).

The design contained herein addresses the problems of slicing and pulling using differentiated club heads for each iron in a normal set of clubs.

SUMMARY

An improved set of golf club irons includes a plurality of irons which may be designated by numbers 1 through 11, each iron having a shaft and a club head depending from the shaft. The higher the designation number, the shorter the shaft and more lofted the club head. Each club head has a heel, a toe, a sole and a planar striking face, the face having a center plane between the heel and the toe. The center plane is perpendicular to the sole of the club. A center of gravity for the longest iron, the 1-iron, is spaced from its center plane and is located near the heel of the club head where the club head is affixed to the shaft. As the designation number of each iron increases, the club heads are shaped so that their centers of gravity progress from near the heel of each club head toward the toe of the club head, with the shortest iron in the set having its center of gravity located nearest the toe.

Further features and advantages of the invention will become apparent from the following detailed description and accompanying drawings.

DETAILED DESCRIPTION OF THE PREFERRED EMBODIMENT

Figure 1:
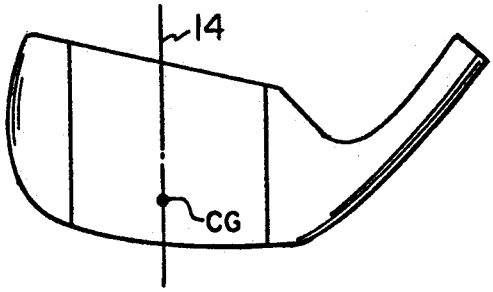
FIG. 1 PRIOR ART
FIG. 1 is a front elevation showing a prior art club head with its center of gravity at the center of the club head.
Figure 2:
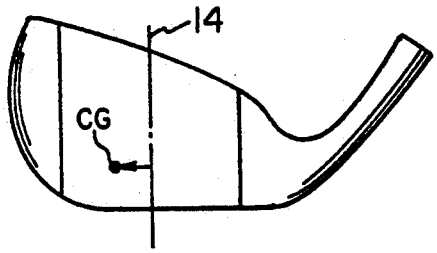
FIG. 2 PRIOR ART
FIG. 2 is a front elevation showing a prior art club head for a 2-iron having its center of gravity toward a toe of the club head.
Figure 3:
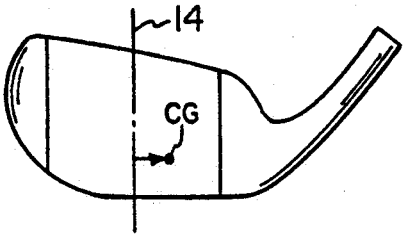
FIG. 3 PRIOR ART
FIG. 3 is a front elevation showing a prior art club head for a 9-iron having its center of gravity toward a heel of the club head.
Figure 4:
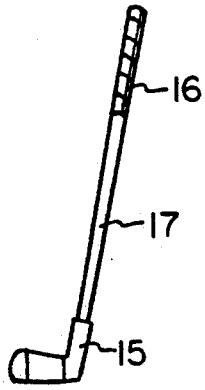
FIG. 4 is a front elevation showing a golf club.
Figure 10:
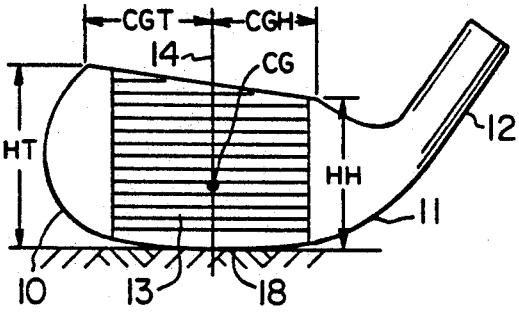
FIG. 10 PRIOR ART
FIG. 10 is a detailed front elevation showing center of gravity and height dimensions for a club head in accordance with the prior art.

A set of iron golf clubs might consist of iron Nos. 1 through 11, typically assembled so the 1-iron is the least lofted and longest in overall shaft length, and, in order of numerical progression, each following club is often assembled ½ inch shorter, with the most lofted 11-iron having the shortest shaft length. All irons numbered between 1 and 11 may generally be called intermediate irons, and the higher their designation number, the shorter their shaft and the more lofted they become. The heaviest component in any assembled club is a head 15 (FIG. 4), located at the bottom of a shaft 17 opposite a grip end 16. The head 15 is perforce, at maximum distance from the golfer's hands, which hold the club at the grip end 16 (FIG. 4). The head has a planar striking face 13 and the head has a finite width (CGT+CGH) from a heel 11, where the shaft 17 is affixed, to a toe 10 (FIG. 10). Each head 15 has a center plane 14 located between the toe 10 and the heel 11. The center plane 14 is generally perpendicular to a sole 18 of the club, which is the portion of the club that contacts the ground and the striking face. The center plane may be but need not be represented by indicia on the striking face. The angle between the planar striking face 13 and sole 18 determines the "loft" of the club. The smaller the angle, the greater the loft.

Figure 5:
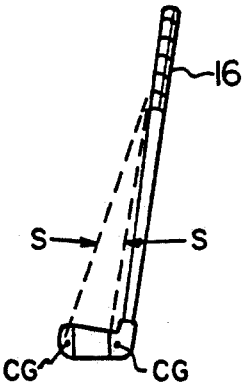
FIG. 5 is a front elevation of the golf club of FIG. 4 showing a distance between a grip end and the center of gravity for the club head.

During a swing, the golfer must accelerate the head 15. The mass of the head has a center of gravity, CG, and acts as though all the mass is at that point. The location of that center of gravity will determine the effective distance the mass is from the golfer's hands, i.e., towards the heel—shorter; towards the toe—longer (FIG. 5). CG1 indicates location of the center of gravity in the toe of the head, with its corresponding effective distance being S−1. CG2 indicates location in the heel of the head with a shorter effective distance, i.e., S−2. The force the golfer must exert to attain a desired club head speed at impact with the ball can be viewed mathematically as:

$$P = \frac{MV_F^2}{2S} + MG$$

where P is total force applied by the golfer;
S is the distance to be traveled by the club;
M is the mass of the club head; and
G is the gravitational constant.

Any increase in distance traveled will mean a needed increase in exerted force by the golfer if the $V_F$, or velocity of the club at impact, is to be maintained. If the distance, S, is lowered, the golfer's P, or exerted force, can be lowered; or if he maintains his exerted force, then $V_F$, velocity of the club at impact, shall be increased.

Figure 8:
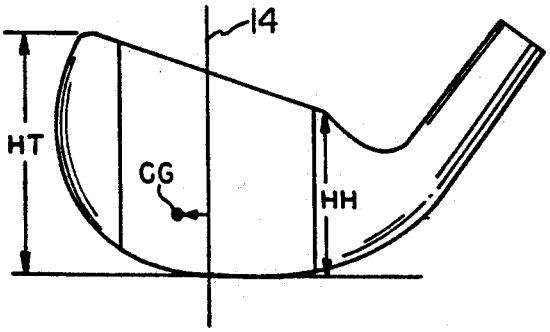
FIG. 8 is an enlarged front elevation showing center of gravity and height dimensions for a 9-iron in accordance with the present invention.
Figure 9:
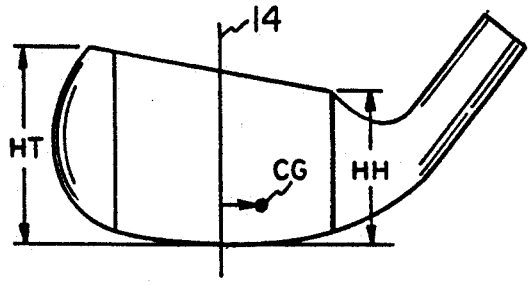
FIG. 9 is an enlarged front elevation showing center of gravity and height dimensions for a 2-iron in accordance with the present invention.

By moving the center of gravity towards the heel of the longer clubs, the effective distance, S, is decreased. The observed results are that the golfer has an easier time accelerating the club and is less apt to have it twist in his hands, thus opening the club face 13 in the impact zone to induce "slicing". For these purposes we have elected to call the relationship of distance to point of effective mass "inertial drag". On the longer clubs this invention places the CG towards the heel (FIG. 9). On the shorter clubs, the design intent is the reverse of the longer clubs, placing the CG towards the toe. Here the distance to point of effective mass, i.e., inertial drag, is increased to more square up the club head at impact, to retard the "pull" action on the ball so often found (FIG. 8). In effect, the invention provides a set of iron clubs more variable in length than the prior art, by virtue of variable locations of center of mass on the several heads (FIG. 5).

Additionally, according to the invention, a vertical height HT of the toe 10 on long-shafted irons, such as that shown in FIG. 9, is less than the vertical height HT' of the toe 10 on short-shafted irons, shown in FIG. 8. Likewise, the vertical height HH of the heel 11 on the long-shafted irons is less than the vertical height HH' of the heel 11 on short-shafted irons. However, the differential between HT and HH on long-shafted irons is less than the differential between HT' and HH' on short-shafted irons.

In can be readily demonstrated that many golfers will hit long irons more easily if the irons are made at a length shorter than normal, even though the lofts of such clubs are closer to perpendicular to the ground. However, the velocity of the club is necessarily reduced, all other things being equal, because of the smaller arc of the golfer's swing, measured from his hands to the club head. This produces a loss of distance, since final velocity at impact is perforce reduced. This invention aids the golfer with the feel of a shorter than normal long iron, while preserving the desired length of club for final velocity purposes.

Figure 6A:
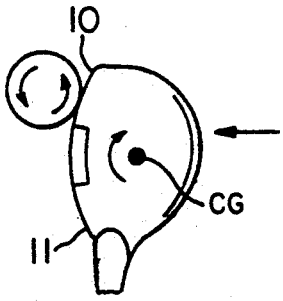
FIG. 6A and FIG. 6B are top views of a club head for a wood displaying a "gear effect"
Figure 6B:
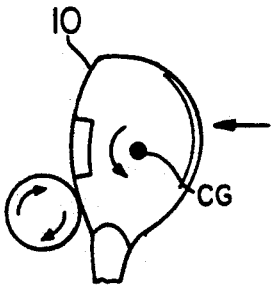

"Gear Effect" is a phenomenon known for many decades (FIGS. 6A and 6B). The face of a club remains in solid contact with the ball for a very short period of time (variable depending on the acceleration of the club), and is commonly estimated at one-half a millisecond (see U.S. Pat. No. 4,512,577). This is nonetheless sufficient time for the head to rotate at impact if contact with the ball is not in alignment with the head, center of gravity of the one to the other as measured in the vertical plane (FIGS. 6A and 6B). In looking at the impact of ball and club at the toe portion of the head, beyond the center of gravity of the head, the ball receives a right to left, or "hook" spin, by virtue of the head rotating during impact (FIG. 6A). (A mirror result will occur for a left-handed player.) The converse is true if impact with the ball is inside the center of gravity, towards the heel of the head. Such a collision imparts left to right spin, or a "slice" (FIG. 6B).

Knowing this, manufacturers have for decades rounded the wood club faces (i.e., driver, 3-wood, etc.) and call it "bulge" (FIGS. 6A and 6B). The idea is to start the ball to the right of target in the case of a toe hit, so the natural spin will then curve the ball towards the center and on target. Again, the converse is true in the case of heel hits, where the ball starts to the left of target, and the natural spin brings it back towards the center. The governing bodies, however, prohibit such curved faces on iron heads.

Figure 7:
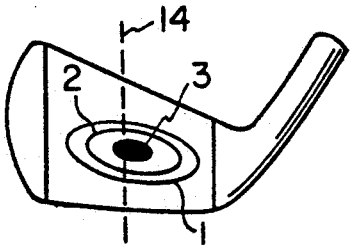
FIG. 7 is a front elevation of a club head for an iron showing a range of contact with a golf ball for average golfers, good golfers and professional golfers.
Figure 11:
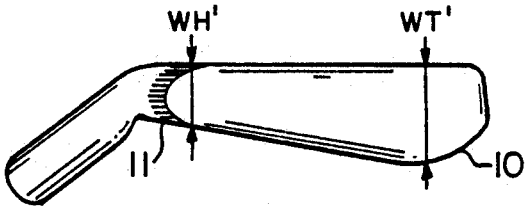
FIG. 11 is a bottom view showing sole width dimensions for a 9-iron in accordance with the present invention.
Figure 12:
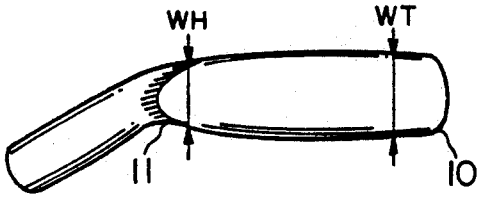
FIG. 12 is a bottom view showing sole width dimensions for a 2-iron in accordance with the present invention.

This invention, by shaping the entire head to have the center of gravity at heel locations on long irons (FIG. 9), insures a greater percentage of head—ball collisions near the CG, or beyond it towards the toe, further inhibiting the "slicing" problem. In the case of short irons, with the entire head shaped to have the center of gravity towards the toe (FIG. 8), a greater percentage of head—ball collisions will occur on the heel side of the CG, combating the "pull". Golfers of any proficiency level cannot make contact at the same place on a head repetitively. FIG. 7 shows the typical pattern of collision points at several skill levels, the imaginary ellipse marked 1 being average players, marked 2 being good players, marked 3 being professional players. This invention accommodates the reality of variable contact points on the club face, with the realities of "slicing" and "pulling", by positive use of "gear effect". Particularly, FIGS. 11 and 12 depict the difference in sole width between the heel and toe for a 2-iron and a 9-iron in a set of golf clubs according to the present invention. Furthermore, Table III, below, illustrates the specific dimensions of a prototype set of golf clubs according to the present invention.

TABLE III

| | SOLE WIDTH DIMENSIONS | |
|---|---|---|
| IRON NUMBER | WIDTH OF SOLE AT HEEL (WH) | WIDTH OF SOLE AT TOE (WT) |
| 1 | 16 | 18 |
| 2 | 16 | 19 |
| 3 | 16 | 20 |
| 4 | 16.5 | 20.5 |
| 5 | 16.5 | 21 |
| 6 | 16.5 | 22 |
| 7 | 17 | 23.5 |
| 8 | 17.5 | 24 |
| 9 | 18 | 25 |
| 10 | 18 | 26 |
| 11 | 19 | 28 |

ALL MEASUREMENTS ARE IN MM'S.

As demonstrated by Table III, a sole width WH at the heel 11 on long-shafted irons, such as the 2-iron shown in FIG. 12, is less than a sole width WH' at the heel 11 on short-shafted irons, shown in FIG. 11. Likewise, a sole width WT at the toe 10 on the long-shafted irons is less than a sole width WT' at the toe 10 on short-shafted irons. However, the differential between WT and WH on long-shafted irons is less than the differential between WT' and WH' on short-shafted irons.

Table II, below, shows actual dimensions for two prototype sets of golf clubs according to the present invention. Table II corresponds to FIGS. 8 and 9 and demonstrates the varying height differentials between heel and toe which occur as one progresses through the golf club set. For instance, the height differential on a 1-iron is 10 millimeters while the height differential on an 11-iron is 23 millimeters on clubs designed for those who can swing above 80 miles per hour. This is one design which can vary the center of gravity locations on iron club heads, according to the invention.

TABLE II

HEIGHT DIMENSIONS FOR EACH IRON CLUB TO ACHIEVE VARIABLE HEAD CENTER OF GRAVITY LOCATIONS

| | ABOVE 80 MPH* | | BELOW 80 MPH | |
|---|---|---|---|---|
| IRON NUMBER | HH | HT | HH | HT |
| 1 | 28 | 38 | 28.5 | 38 |
| 2 | 28.5 | 38.5 | 29 | 38.5 |
| 3 | 29 | 39.5 | 29.5 | 39 |
| 4 | 29 | 40 | 30 | 39.5 |
| 5 | 29 | 42 | 30 | 41 |
| 6 | 28 | 42.5 | 30 | 41.5 |
| 7 | 27 | 43 | 29 | 42 |
| 8 | 26 | 44 | 28 | 43 |
| 9 | 25 | 45 | 27 | 44 |
| 10 | 25 | 46 | 26 | 45 |
| 11 | 25 | 48 | 25 | 46 |

*80 MPH REPRESENTS DRIVER SWING SPEED, THE COMMON CLUB USED BY PROFESSIONALS TO FIT ENTIRE CLUB SETS.
**ALL MEASUREMENTS ARE IN MM'S.

A second way to vary center of gravity locations is to vary the width of the sole at the heel and the toe of the iron club head as one progresses through the set.

Figure 13:
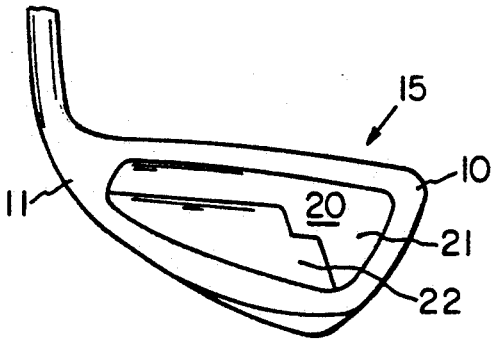
FIG. 13 is a rear view of the 9-iron of FIG. 11.
Figure 14:
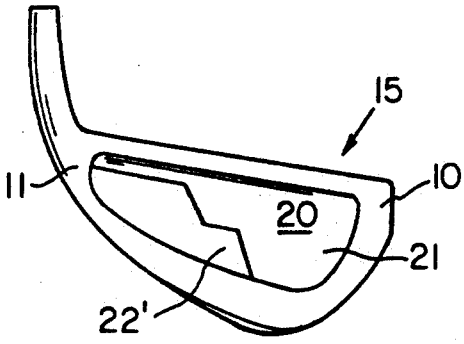
FIG. 14 is a rear view of the 2-iron of FIG. 12.

Finally, FIGS. 13 and 14 demonstrate a third mechanism for varying center of gravity locations known as "muscle backing". Each club head 15 has a cavity 20 above its rear face 21. Inside the cavity, a raised portion 22 or "backing" is formed in the club head 15. For the 9-iron, the backing 22 extends further toward the toe 10 of the club head 15, thus placing more club head weight near the toe and locating the CG on the toe side of center plane 14. For the 2-iron, backing 22' is concentrated more near heel 11, to locate the CG on the heel side of center plane 14. For the intermediate irons, progressing from 3-iron to 8-iron, backing 22 progresses from heel 11 toward toe 10 to vary the location of the CG according to the invention, as described above.

The above three arrangements for varying center of gravity locations on iron club heads may be used exclusively or in combinations with one another in accordance with the invention. The invention is preferably practiced with cavity-back irons, but may also be applied to traditional forged iron designs.

Having described the presently preferred embodiment of the invention, it will be understood that it is not intended to limit the invention except within the scope of the following claims.

I claim:

1. In a set of golf club irons, each iron having a shaft with a grip end and a club head opposite said grip end, said club head having a sole, a heel which is affixed to said shaft and a toe opposite said heel, with a planar striking face extending between said heel and said toe, said set including a long-shafted iron, a plurality of intermediate irons which are progressively shorter and more lofted than said long-shafted iron, and a short-shafted iron, each club head on said iron having a center plane perpendicular to said sole and located between said heel and said toe, the improvement comprising:

the head of said long-shafted iron having its weight concentrated adjacent said heel to have its center of gravity in a first position spaced from its center plane a first distance toward said heel;

the head of said short-shafted iron having its weight concentrated adjacent said toe to have its center of gravity in a second position spaced from its center plane a second distance toward said toe;

each intermediate iron having a center of gravity located on its club head between said first position and said second position, with the location of said center of gravity of each intermediate iron progressing from said first position toward said second position as the length of each shaft decreases;

wherein a differential between a vertical height of the toe on said long-shafted iron and a vertical height of the heel on said long-shafted iron is less than a differential between a vertical height of the toe on said short-shafted iron and a vertical height of the heel on said short-shafted iron.

2. In a set of golf club irons, each iron having a shaft with a grip end and a club head opposite said grip end, said club head having a sole, a heel which is affixed to said shaft and a toe opposite said heel, with a planar striking face extending between said heel and said toe, said set including a long-shafted iron, a plurality of intermediate irons which are progressively shorter and more lofted than said long-shafted iron, and a short-shafted iron, each club head on said iron having a center plane perpendicular to said sole and located between said heel and said toe, the improvement comprising:

the head of said long-shafted iron having its weight concentrated adjacent said heel to have its center of gravity in a first position spaced from its center plane a first distance toward said heel;

the head of said short-shafted iron having its weight concentrated adjacent said toe to have its center of gravity in a second position spaced from its center plane a second distance toward said toe;

each intermediate iron having a center of gravity located on its club head between said first position and said second position, with the location of said center of gravity of each intermediate iron progressing from said first position toward said second position as the length of each shaft decreases;

wherein a differential between a sole width at the toe on said long-shafted iron and a sole width at the heel on said long-shafted iron is less than a differential between a sole width at the toe on said short-shafted iron and a sole width at the heel on said short-shafted iron.

3. The golf club set of claim 2 including a raised backing on a rear face of each iron club head, said backing concentrated adjacent said heel on said long-shafted iron and extending across said rear face toward said toe on said short-shafted iron.

* * * * *

UNITED STATES PATENT AND TRADEMARK OFFICE

CERTIFICATE OF CORRECTION

PATENT NO. : 5,295,686

DATED : March 22, 1994

INVENTOR(S) : Harry C. Lundberg

It is certified that error appears in the above-indentified patent and that said Letters Patent is hereby corrected as shown below:

Column 2 Line 23 "as" should read --an--.

Column 4 Line 26 delete "and".

Column 4 Line 29 "art." should read --art;--.

Column 4 Line 35 "invention." should read --invention;--.

Column 5 Line 54 "In" should read --It--.

Column 6 Lines 43-44 through Column 7 Line 6 from the sentence beginning with "Particularly," including TABLE III and the paragraph ending with "short-shafted irons." should be located at Column 7 Line 39 as a new sentence after "set."

Signed and Sealed this

Eleventh Day of October, 1994

*Attest:*

Bruce Lehman

BRUCE LEHMAN

*Attesting Officer*

*Commissioner of Patents and Trademarks*